US008668482B2

(12) United States Patent
Sundermann

(10) Patent No.: US 8,668,482 B2
(45) Date of Patent: Mar. 11, 2014

(54) FORMWORK AND FORMWORK METHOD OF A CONCRETE CONSTRUCTION

(76) Inventor: Marcus Sundermann, Barntrup (DE)

( * ) Notice: Subject to any disclaimer, the term of this patent is extended or adjusted under 35 U.S.C. 154(b) by 457 days.

(21) Appl. No.: 12/989,912

(22) PCT Filed: Apr. 27, 2009

(86) PCT No.: PCT/DE2009/000577

§ 371 (c)(1),
(2), (4) Date: Oct. 27, 2010

(87) PCT Pub. No.: WO2009/132622

PCT Pub. Date: Nov. 5, 2009

(65) Prior Publication Data

US 2011/0037186 A1 Feb. 17, 2011

(30) Foreign Application Priority Data

Apr. 28, 2008 (DE) ..... 10 2008 021 202

(51) Int. Cl.
*E04G 11/00* (2006.01)

(52) U.S. Cl.
USPC ..... 425/63; 249/24; 249/33; 249/48; 249/162; 249/163; 249/169; 249/189

(58) Field of Classification Search
USPC ..... 425/63–65; 249/19–20, 24, 33, 48, 249/161–163, 168, 169, 189; 264/333, 33
See application file for complete search history.

(56) References Cited

U.S. PATENT DOCUMENTS

| | | | | |
|---|---|---|---|---|
| 4,040,774 | A * | 8/1977 | Scheller | 425/65 |
| 4,249,870 | A * | 2/1981 | Krabbe et al. | 425/63 |
| 4,403,460 | A * | 9/1983 | Hills | 52/745.01 |
| 4,804,320 | A * | 2/1989 | Sommer et al. | 425/65 |
| 5,109,953 | A | 5/1992 | Mathis | |
| 6,530,552 | B2 * | 3/2003 | Bergaretxe | 249/4 |
| 6,557,817 | B2 * | 5/2003 | Waldschmitt et al. | 249/20 |
| 2003/0034576 | A1 * | 2/2003 | Russell | 264/33 |
| 2003/0052249 | A1 * | 3/2003 | Waldschmitt et al. | 249/20 |
| 2005/0263672 | A1 | 12/2005 | Jaruzel et al. | |
| 2005/0268818 | A1 * | 12/2005 | Colavito et al. | 106/661 |
| 2007/0119116 | A1 * | 5/2007 | Arozena Bergaretxe et al. | 52/633 |
| 2011/0171336 | A1 * | 7/2011 | Schwoerer et al. | 425/63 |

FOREIGN PATENT DOCUMENTS

| | | | | |
|---|---|---|---|---|
| DE | 902 188 | | 1/1954 | |
| DE | 15 34 850 | | 12/1968 | |
| DE | 24 10 877 | | 9/1974 | |
| DE | 25 06 361 | | 8/1975 | |
| DE | 27 09 044 | A1 * | 9/1978 | E04G 11/28 |
| DE | 2725114 | A1 * | 12/1978 | E04G 11/04 |

(Continued)

OTHER PUBLICATIONS

Translation of DE 2725114 A1.*

*Primary Examiner* — Dimple Bodawala
(74) *Attorney, Agent, or Firm* — Cozen O'Connor

(57) ABSTRACT

In a formwork in concrete construction, particularly for a round vessel, in which, for a further construction section, formwork elements enclose an upper edge of a completed wall portion, are secured to this completed wall portion, and protrude over this wall portion for filling with concrete, vertical members are arranged parallel to, and at a distance from, the wall portion, and a slide is displaceable at every vertical member, and formwork elements are connected to the slide.

9 Claims, 4 Drawing Sheets

(56) References Cited

FOREIGN PATENT DOCUMENTS

| | | | | | |
|---|---|---|---|---|---|
| DE | 43 18 012 | | | 12/1993 | |
| DE | 4318012 | A1 | * | 12/1993 | ..... E04G 11/28 |
| DE | 200 00 497 | | | 6/2000 | |
| DE | 102 40 372 | | | 3/2004 | |
| EP | 0 457 171 | | | 11/1991 | |
| GB | 1 469 141 | | | 3/1977 | |
| GB | 1 469 142 | | | 3/1977 | |
| JP | 05133097 | A | * | 5/1993 | ..... E04G 11/22 |
| JP | 06240864 | A | * | 8/1994 | ..... E04G 11/22 |
| JP | 06317014 | A | * | 11/1994 | ..... E04G 11/22 |
| JP | 08144514 | A | * | 6/1996 | ..... E04G 11/22 |

* cited by examiner

FORMWORK AND FORMWORK METHOD OF A CONCRETE CONSTRUCTION

PRIORITY CLAIM

This is a U.S. national stage of Application No. PCT/DE2009/000577, filed on Apr. 27, 2009, which claims priority to German Application No: 10 2008 021 202.4, filed: Apr. 28, 2008, the contents of which are incorporated herein by reference.

BACKGROUND OF THE INVENTION

1. Field of the Invention

The invention is directed to a formwork in concrete construction, particularly for an annularly rising wall of a round vessel, in which, for a further construction section, formwork elements enclose an upper edge of a completed wall portion, are secured to this completed wall portion and protrude over this wall portion for filling with concrete.

Further, a method for concrete construction is also described for forming an annularly rising wall of a round vessel, particularly using the formwork according to the invention.

2. Related Art

Formworks and methods for forming in concrete construction are known in diverse, proven embodiment forms. However, formworks for curved walls continue to present problems, especially in monolithic round vessels which, more recently, can often be used for bio gas installations or as silos in agriculture. Vessel heights of up to 20 m and diameters of up to 35 m require careful, high-quality formwork techniques.

In a known formwork technique, formwork elements such as those disclosed in DE 200 00 497 U1 or DE 102 40 372 A1 are combined to form a plurality of rings arranged one above the other. As the wall height increases, a lower inner ring and a lower outer ring enclose an upper edge of a completed wall portion and support the concentric rings of additional formwork elements lying above them for completing another wall portion by filling the intermediate space between the rings with concrete.

When this newly filled wall portion of the vessel has hardened sufficiently to be capable of supporting loads, the lower rings are removed and placed upon the upper rings.

Moving the rings is extremely time-consuming and, further, may be hazardous to workers at the aforementioned heights. Moreover, moving and, in particular, dismantling the rings of formwork elements after completion of the vessel requires considerable technical resources, for example, cranes.

SUMMARY OF THE INVENTION

One embodiment of the invention provides a formwork for concrete construction and a method of concrete construction for forming an annularly rising wall of a round vessel allowing work to be performed in a distinctly safe and rapid manner.

A formwork for concrete construction, particularly for an annularly rising wall of a round vessel, formwork elements enclose an upper edge of a completed wall portion for another construction section and are secured to this completed wall portion. The formwork elements protrude over this wall portion for filling with concrete, the set of technical problems mentioned above is solved, in that vertical members are arranged parallel to, and at a distance from, the wall portion, in that a slide is displaceable at every vertical member, and in that formwork elements are connected to the slide.

The formwork according to one embodiment of the invention offers a variety of advantages. Cranes or the like are not required because the height of the formwork is adjustable by slides at vertical members which are arranged parallel to and at a distance from the wall portion. Also, in particular, fewer formwork elements can be used because the height of the formwork can be reduced compared to conventional forms.

Further, a particular advantage in connection with an annularly rising wall, e.g., of a round vessel is that, in contrast to conventional methods, the rings of the formwork elements need no longer be dismantled and relocated individually.

A movement path of the slide at the vertical member corresponds approximately to the height of the formwork, but is offset relative to the formwork. This affords the possibility of letting reinforcement steel mats protrude over the wall portion to provide an overlapping with other reinforcement steel mats of following construction sections for connecting the reinforcement steel mats to one another.

The movement path is 2 m, particularly between 1.80 m and 2.20 m, corresponding to dimensions of the reinforcement steel mats. Further, work can still be performed above this height without the aid of ladders, platforms, or similar problematic tools.

In order to adapt in an optimal manner to a given height, particularly of a round vessel, it is further provided in a constructional embodiment that the vertical member has a plurality of segments, each of which corresponds to the height of the formwork, and that the slide can be fastened to each segment, wherein the distance of the fastening locations preferably corresponds again to the height of the formwork.

Accordingly, the height of the formwork, the length of the movement path, and the height of a reinforcement steel mat are adapted to one another in an optimal manner.

In one embodiment of the invention, a lifting device is arranged between the slide and the formwork. When the slide is fastened to the vertical member, the formwork can then be raised by the lifting device for another construction section.

There are many possible variants for the design of the lifting devices. A hydraulically and/or pneumatically actuated lifting device is preferable because a synchronous running of the individual lifting devices can be achieved comparatively easily. Spindle drives, a possible alternative, are very precise but are relatively slow, and there is a considerable risk of soiling precisely at the construction sites under discussion. Similarly, it is possible to use cables or belts, but they must be guided on pulleys in a complicated manner.

Regardless of the construction of the lifting devices, they should preferably be designed such that lifting is possible in two directions. One and the same lifting device can then be used after the formwork is secured to an upper edge of a wall portion to advance the slide fastened to the vertical member so that this slide can be secured again to the vertical member in a higher position.

Consequently, the lifting height of the lifting device should also correspond approximately to the movement path.

In one embodiment of the invention, formwork elements can be connected on both sides of the wall portion by cantilever arms which reach over the wall portion so that vertical members with slides and lifting devices need only be arranged on one side of the wall portion.

In order to do without cranes or the like also when dismantling the formwork after completion of the wall, a cable hoist or belt hoist is connected at one end to a formwork element adjacent to the vertical member, the cable hoist or belt hoist is guided around a pulley arranged at the foot of the vertical member, a pulley is arranged above the finished wall and the cable hoist or belt hoist is again guided around this pulley, and the cable hoist or belt hoist is fastened at the other end to a formwork element arranged on the opposite side of the wall. In a simple manner, the pulley can be placed upon the finished wall so that it need not be brought into the position above the wall until after the wall has been completed.

In order not to damage the formwork, e.g., due to canting, particularly when lowering the formwork after completion of the wall, it can be provided in another construction that at least one formwork element is guided by positive engagement at a guide profile which is fixed with respect to the wall. A guide profile of this kind can be constructed in a simple manner as a tongue-in-groove type arrangement. In practice, formwork elements of this kind are preferably inserted equidistantly so that loads are also distributed as uniformly as possible.

The formwork according to the invention can be provided with a frame in a simple manner when a supporting arm is articulated at an upper edge and a lower edge of a formwork element, when the free ends of the supporting arms are braced diagonally considered from the side, and when a support which is vertically upright in the use position is connected to the free ends.

In this way, a system of supporting members on which planks can be placed for a frame is formed in the manner of a framework. Further, nets, tarps, or the like can be secured to the vertically upright supports as is customary.

In this connection, it is advantageous that a frame of the type mentioned above can be used in different locations with the formwork according to the invention. After removing the vertically upright support, however, the supporting arms of a formwork element of this kind can be swiveled for a space-saving support or transport on the formwork elements.

Further, according to one embodiment of the invention, in a formwork for an annularly rising wall of a round vessel, the vertical members are arranged at an inner ring of formwork elements. This is preferably carried out in a uniformly distributed manner so that the occurring forces, merely normal forces, can be safely absorbed.

In particular, the formwork according to one embodiment of the invention permits a method of concrete construction for forming an annularly rising wall of a round vessel in which it is provided, for a further construction section that the formwork elements enclosing a completed wall portion are removed from the completed wall portion by reducing the radius of the formwork elements forming an inner ring and by increasing the radius of the formwork elements forming an outer ring, that the two rings of formwork elements are moved jointly at vertical members, and that a lower edge of the formwork elements is brought into contact with an upper edge of the completed wall portion by increasing the radius of the formwork elements forming the inner ring and by reducing the radius of the formwork elements forming the outer ring.

According to one embodiment of the invention, a formwork for a round vessel need no longer be removed as the height of the structure increases; rather, the formwork is raised in its entirety. For this purpose, it is provided that the rings are moved by lifting devices which are supported on slides fastened to the vertical member. The method should be carried out as uniformly as possible circumferentially and vertically so as to prevent canting of the formwork and, as a result, possible damage to the completed wall portion or to the formwork itself.

When the rings are raised, they are subsequently secured to the upper edge of the wall portion by a lower edge of the formwork elements, and the lifting devices can then reposition the slides at the vertical member along the movement path which approximately corresponds to the lift of the lifting device. The repositioned slides are then fastened to the vertical member again so as to restore the starting point for a further construction step.

In the method according to one embodiment of the invention, the inner ring and outer ring of the formwork elements can be lowered at the same time after completion of the wall. Because this is preferably carried out by cable hoists or belt hoists according to the invention, formwork elements connected to vertical members are arranged in a uniformly distributed manner, and formwork elements which are adjustable in circumferential direction are centrally arranged between the formwork elements connected to the vertical member for changing the radius of a ring.

These measures result in a uniform, symmetrical application and distribution of forces.

Further, with respect to these loads, changes in the circumference through the adjustment of the formwork elements should be carried out in a homogeneous manner. For this reason, the adjustment is preferably carried out by spindle drives, hydraulically, or pneumatically.

BRIEF DESCRIPTION OF DRAWINGS

The invention will be described more fully with reference to the drawings in which embodiment examples are only shown schematically. In the drawings.

DETAILED DESCRIPTION OF THE DRAWINGS

Figure 1:
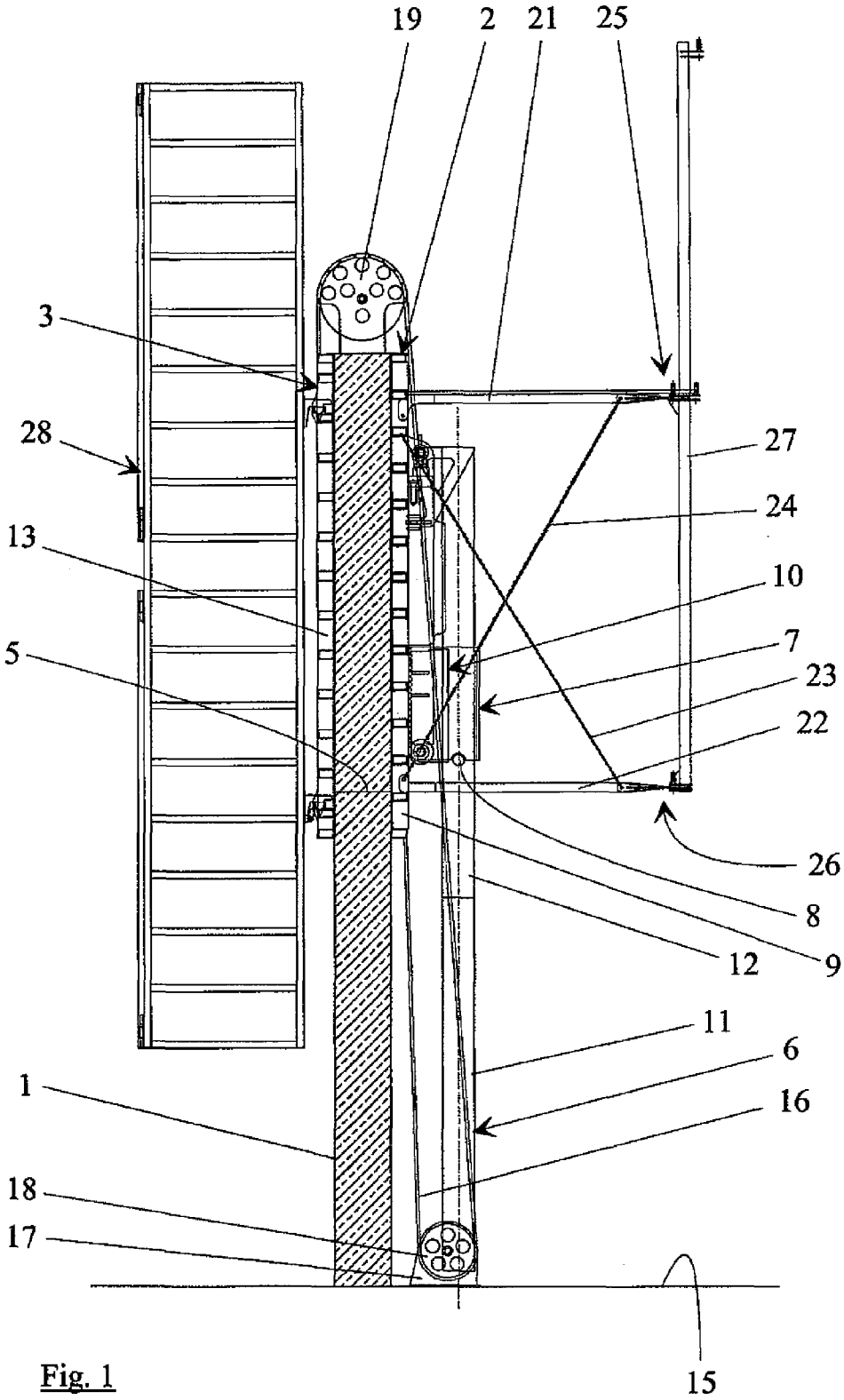
FIG. 1 is a cross section through a double-walled formwork according to the invention.

The formwork, according to one embodiment of the invention, at an annularly rising completed wall portion 1, for example, of a round vessel, will be explained more fully with reference to FIGS. 1 to 4. The formwork has an inner ring 2 according to FIG. 3 and an outer ring 3 that comprises a plurality of formwork elements 4.

By increasing the radius of the inner ring 2 and reducing the radius of the outer ring 3, the formwork elements 4 of the rings 2, 3 enclose an upper edge 5 of the completed wall portion 1 by their lower edges. When the rings 2, 3 are secured and the formwork elements 4 protrude over the completed wall portion 1, the intermediate space remaining between the formwork elements 4 and rings 2, 3 can be filled with concrete.

In order to carry out a further section of the construction, the rings 2, 3 are freed from the hardened wall portion 1 by changing their radius and are raised together for another construction section.

To this end, vertical members 6 are arranged at the inner ring 2 parallel to, but at a distance from, the wall portion 1. The vertical members 6 are arranged in a uniformly distributed manner, at a distance of 90° in the embodiment example, along the circumference of the inner ring 2.

A slide 7, and a locating pin 8 (see FIG. 1), is displaceable and fastenable at each vertical member 6. A hydraulic lifting device 10 is arranged between the slides 7 and a formwork elements 9 of the inner ring 2 of the formwork. The hydraulic lifting device 10 lifts the two rings 2, 3 of the formwork for a further construction section, these rings 2, 3 having been detached from the wall portion 1.

When the inner ring 2 and the outer ring 3 are secured to the upper edge portion 5 for another construction section, the lifting device 10 acting in two directions likewise moves the slide 7 into a new, higher position, where it is again secured according to FIG. 1.

The movement path of the slide 7 on the vertical member 6 corresponds to the height of the formwork, which is preferably between 1.80 m and 2.20 m, corresponding to the dimensions of a reinforcement steel mat being used and an optimal work height. The vertical member 6 to which the slide 7 can be fastened has individual segments 11, 12 of a corresponding height so that the vertical member 6 can be optimally adapted to the height of the wall portions 1 for every construction section.

Figure 2:
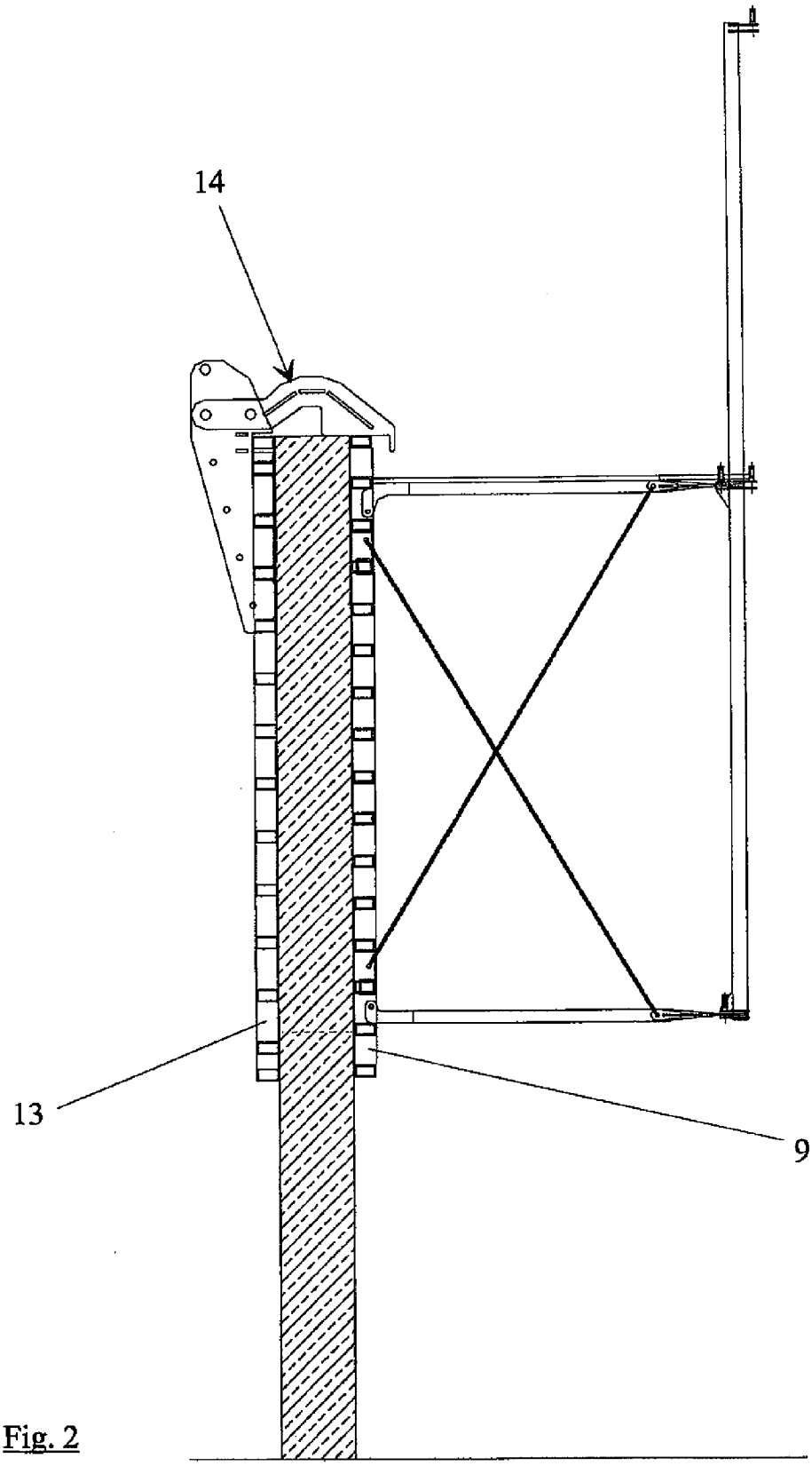
FIG. 2 is a raising of the formwork.

In order also to raise the outer ring 3 by the lifting device 10, the opposite formwork elements 4, 13 are connected by cantilever arms 14 reaching over the wall portion 1 (see FIG. 2). When the wall is completed, the inner ring 2 and the outer ring 3 are lowered onto a base 15. For this purpose, a cable hoist 16 is attached to the formwork elements 9, guided around a pulley 18 arranged at the foot 17 of the vertical member 6, guided again around a pulley 19 placed above the completed wall, preferably on top of the latter, and then secured to the formwork elements 13.

Corresponding to the relocation of the inner ring 2 and outer ring 3 for the construction of the wall 1, the two rings 2, 3 are lowered successively by the lifting device 10 after completion of the wall 1.

Figure 3:
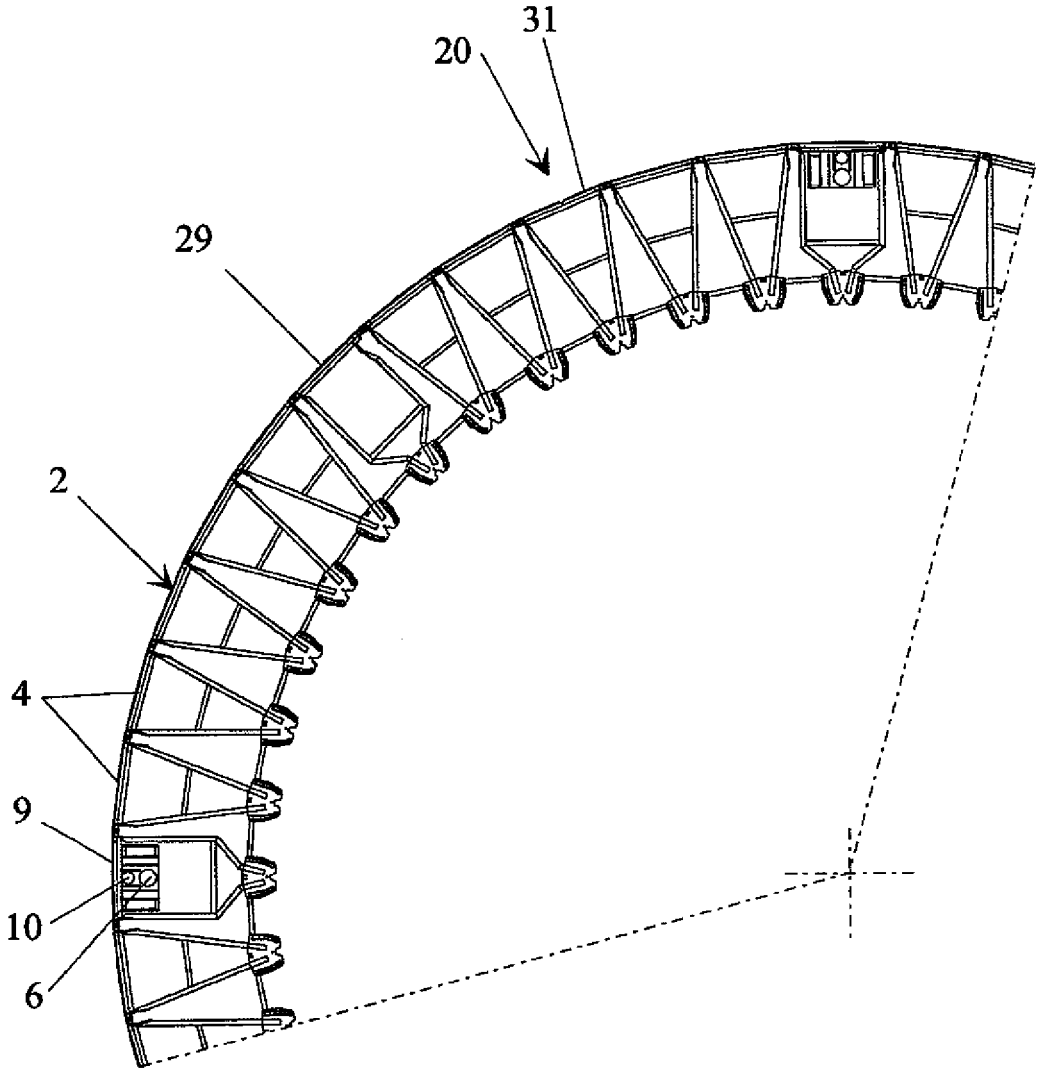
FIG. 3 is a sectional top view of a formed, annularly rising wall.

In order that the formwork can be set down evenly without canting, particularly while lowering the inner ring 2 and outer ring 3, the formwork element 31 has a groove 20, shown in a magnified scale in FIG. 3, a guide profile which is fixed with respect to the wall engaging therein (not shown) so that the formwork element 31 is guided at this guide profile.

In addition, the formwork element 9 has an articulated supporting arm 21, 22 at its upper edge and lower edge, respectively, these supporting arms 21, 22 being braced diagonally, considered from the side referring to FIG. 1 or 2, by wire cables 23, 24. A vertically upright support 27 is connected to the free ends 25, 26 of the supporting arms 21, 22. Planks for scaffolding can easily be placed upon the supporting arms 21, 22, while tarps, nets or the like can be suspended from the support 27.

In FIG. 1, a work cage 28 is connected to the formwork element 13 so that work can also be performed safely below the outer ring 3 of the formwork.

Figure 4:
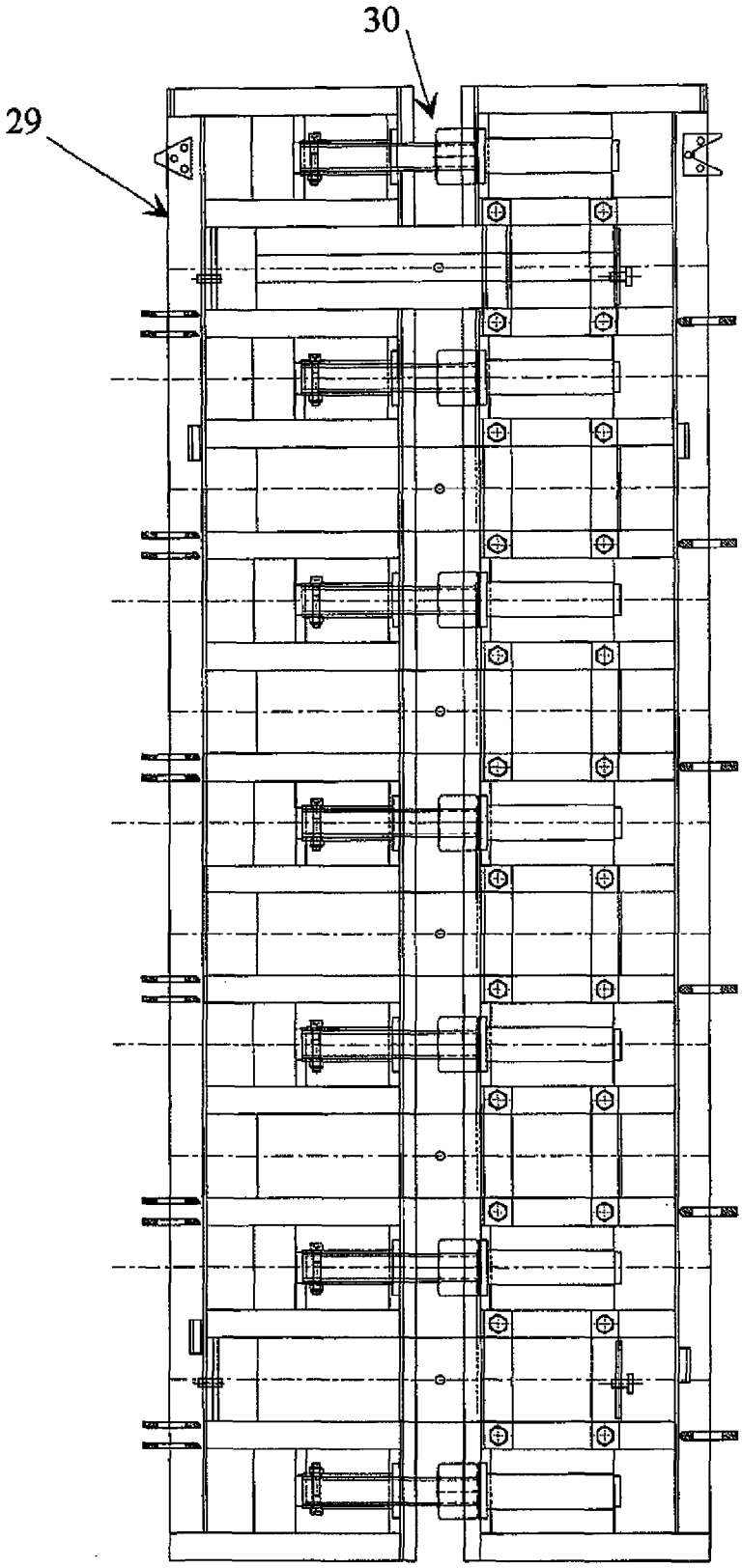
FIG. 4 is an adjustable formwork elements.

To change a radius of the rings 2, 3, formwork elements 29 which are adjustable in circumferential direction are uniformly distributed centrally between the formwork elements 9 connected to the vertical member 6 (compare FIG. 4). In this instance, this is carried out by spindle drives 30.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A formwork in concrete construction for a wall, comprising:

at least one formwork element includes inner and outer rings;

a first supporting arm is coupled at an upper edge of the formwork element;

at least one vertical member arranged at the inner ring parallel to, and at a distance from, the wall;

a respective slide displaceably arranged on the at least one vertical member; and a lifting device, arranged between the slide and the inner ring of the formwork element, and configured to act in two directions on the formwork element below the first supporting arm such that the rings are moved jointly by the lifting device which are supported on slides fastened to the vertical member, wherein a movement path of the slide at the at least one vertical member is offset relative to the formwork, wherein the at least one formwork element is guided by positive engagement at a guide profile which is fixed with respect to the wall.

2. The formwork according to claim 1, wherein a movement path of the slide at the vertical member corresponds to a height of the formwork.

3. The formwork according to claim 2, wherein the vertical member comprises a plurality of segments, each of the plural of segments corresponding to the height of the formwork, the slide is configured to be fastened to each segment at a respective fastening location, and a distance between the fastening locations corresponds to the height of the formwork.

4. The formwork according to claim 1, further comprising:

a second formwork element; and a cantilever arm configured to reach over the wall and configured to be connected to formwork elements on both sides of the wall portion.

5. The formwork according to claim 1, further comprising:

one of a cable hoist and a belt hoist connected at a first end to a formwork element adjacent to the vertical member;

a first pulley arranged at a foot of the vertical member that the one of the cable hoist and the belt hoist is guided around; and a second pulley arranged one of above a finished wall and on the finished wall that the one of the cable hoist and the belt hoist is guided around, wherein the one of the cable hoist and the belt hoist is fastened at a second end to a formwork element arranged on the opposite side of the wall.

6. The formwork according to claim 5, wherein the second pulley is arranged on the finished wall.

7. The formwork according to claim 1, further comprising: a second supporting arm is coupled at a lower edge of the formwork element, wherein a free end of the first and the second supporting arms are braced diagonally considered from a side of the wall, and a vertically upright support is coupled to free ends of the supporting arms.

8. The formwork in concrete construction according to claim 1, wherein the wall is an annularly rising wall of a round vessel.

9. The formwork according to claim 5, wherein the at least one formwork element is an adjustable formwork element configured to be circumferentially adjustable.

* * * * *